US007578528B2

(12) United States Patent
Tölle

(10) Patent No.: US 7,578,528 B2
(45) Date of Patent: Aug. 25, 2009

(54) CONFIGURATION FOR SEALING OFF TWO FLUID-CARRYING SUBASSEMBLIES

(75) Inventor: Stefan Tölle, Schandelah/Cremlingen (DE)

(73) Assignee: Volkswagen AG, Wolfsburg (DE)

( * ) Notice: Subject to any disclaimer, the term of this patent is extended or adjusted under 35 U.S.C. 154(b) by 177 days.

(21) Appl. No.: 11/284,340

(22) Filed: Nov. 21, 2005

(65) Prior Publication Data

US 2006/0108746 A1 May 25, 2006

(30) Foreign Application Priority Data

Nov. 24, 2004 (DE) ..... 10 2004 056 599

(51) Int. Cl.
*F16L 41/00* (2006.01)

(52) U.S. Cl. ..... 285/192; 285/104; 285/123.1; 285/139.2; 285/351; 285/910; 277/563; 277/616; 277/641

(58) Field of Classification Search ..... 285/104–105, 285/108, 110, 139.2, 139.3, 140.1, 192, 13–14, 285/123.1, 123.15, 123.16, 924, 98, 145.1, 285/145.2, 148.6, 351, 910, 917; 277/563, 277/616, 619, 623–624, 641–642
See application file for complete search history.

(56) References Cited

U.S. PATENT DOCUMENTS 3,278,883 A * 10/1966 Lipsey ..... 439/96
3,603,600 A * 9/1971 Lutz ..... 277/345
4,576,386 A 3/1986 Benson et al.
6,389,955 B1 5/2002 Schaefer
2004/0113366 A1 6/2004 Mause et al.

FOREIGN PATENT DOCUMENTS

| | | |
|---|---|---|
| CH | 373934 | 1/1964 |
| DE | 199 04 926 A1 | 8/2000 |
| DE | 203 14 842 U1 | 2/2004 |
| DE | 102 51 561 A1 | 5/2004 |
| EP | 0 505 352 B1 | 3/1995 |
| GB | 837583 | 6/1960 |

* cited by examiner

*Primary Examiner*—Aaron M Dunwoody
*Assistant Examiner*—Fannie Kee

(57) ABSTRACT

A configuration for sealing-off two fluid-carrying subassemblies, in particular for sealing-off a case, the inner space of which is filled with a first fluid and through the inner space of which there is led a pipeline filled with another fluid which flows into a construction space that is separated from the inner space filled with the first fluid by a case wall. Between a first sealing element and a second sealing element there is disposed a supporting ring, which, on each of its side faces assigned to the sealing elements, has a contour for the reception and diversion of a fluid volume which has flowed onto the supporting ring as a result of leakage in the region of the respectively assigned sealing element.

10 Claims, 5 Drawing Sheets

CONFIGURATION FOR SEALING OFF TWO FLUID-CARRYING SUBASSEMBLIES

BACKGROUND OF THE INVENTION

Field of the Invention

The invention relates to a configuration for sealing off two fluid-carrying subassemblies, in particular for sealing off a case, the inner space of which is filled with a first fluid and through the inner space of which is led a pipeline filled with another fluid which flows into a construction space separated from the inner space filled with the first fluid by means of a case wall, at least two sealing elements supported on the pipeline being provided in the region of the leadthrough of the pipeline through the case wall.

For numerous technical applications, it is necessary for fluid-carrying subassemblies to be sealed off, in order both to ensure the functioning capacity of the respective subassembly and to avoid environmental problems, for example due to emerging lubricants. A field of use which is typical in this respect covers internal combustion engines wherein, in addition to gas sealing-off (for example, between the crankcase and cylinder head), sealing is necessary on numerous subassemblies in the liquid range (for example, for engine oil and coolant), in order to prevent an outflow of the respective fluid.

German utility model DE 203 14 842 U1 (Gebrauchsmuster) describes a configuration for connection between a pipeline and a cylindrical junction part. The free end portions of the junction part and of the pipeline designed as a corrugated pipe are first pushed one into the other and are subsequently fixed axially by means of a securing ring. The securing ring is additionally surrounded by a holding clip which lies, on each of the two sides of the securing ring, on the components to be connected. Furthermore, O-rings for liquid sealing-off are inserted in each case in two corrugations of the corrugated pipe. In an alternative version, the securing ring is not pressed on from outside, but, instead, is supported as a spring ring on the inner contour of a corrugation of the corrugated pipe. In that embodiment, too, O-rings for liquid sealing-off are inserted in two further corrugated pipe corrugations.

By means of that technical solution, which, according to the statements in the publication, are suitable preferably for collecting lines on solar collectors, a functional connection can, in principle, be made between two fluid-carrying subassemblies. In this context, a slight leakage is unimportant, insofar as the same fluid is carried in both subassemblies. Problems due to an intermixing of different fluids are consequently ruled out. Furthermore, the fluid volume in the system is sufficiently large, and therefore no functional defects are to be expected even in the event of an outflow of small fluid quantities into the surroundings. Furthermore, such a slight leakage also raises no environmentally relevant objections because the fluid predominantly used is water.

However, an application of the technical solution according to the above-noted DE 203 14 842 U1 or of similar seal systems presents problems insofar as different fluids are carried in the subassemblies to be sealed off relative to one another. This is relevant for designs which have a case, the inner space of which is filled with a first fluid. In this instance, moreover, the case has led through it a pipeline, the inner space of which is filled with another fluid which flows into a construction space which is separated from the inner space filled with the first fluid solely by means of a case wall. Such a configuration is required, for example, for internal combustion engines for leading through water in the oil space. For such applications, even a slight leakage and an intermixing of different fluids which therefore occurs are unacceptable. On the contrary, a leakage-free seal is absolutely necessary at the passage of the pipeline through the case wall.

SUMMARY OF THE INVENTION

It is accordingly an object of the invention to provide a configuration for sealing two fluid-carrying assemblies which overcomes the above-mentioned disadvantages of the heretofore-known devices and methods of this general type and which, at a low outlay in terms of components, cost and assembly, allows effective sealing-off between two subassemblies which, in particular, may be filled with different fluids.

With the foregoing and other objects in view there is provided, in accordance with the invention, a configuration for sealing off a first fluid-carrying subassembly from a second fluid-carrying subassembly, the first subassembly having a case wall formed with a lead-through and the second subassembly having a pipeline extending through the leadthrough, the configuration comprising:

a first sealing element and a second sealing element supported on the pipeline in a region of the leadthrough through the wall of the first subassembly;

a supporting ring disposed between said first sealing element and said second sealing element, said supporting ring having side faces respectively facing said first sealing element and said second sealing element, said side faces having contours for receiving and diverting a fluid volume flowing onto said supporting ring as a result of leakage at a respective one of said first and second sealing elements.

Specifically, there is sealed off a first space in a housing filled with a first fluid relative to a second space, wherein a pipeline filled with a second fluid is guided through a wall separating the first space from the second space and issues into the second space.

The objects of the invention are achieved in that, between the first sealing element and the second sealing element, a supporting ring is arranged, which, on each of its side faces assigned to the sealing elements, has a contour for the reception and diversion of a fluid volume which has flowed onto the supporting ring as a result of leakage in the region of the respectively assigned sealing element. Further refinements are the subject matter of the dependent claims, the technical features and functions of which are described in more detail in the exemplary embodiment.

The configuration according to the invention is suitable for numerous technical applications, wherein it is necessary for subassemblies wherein different fluids are carried to be sealed off relative to one another. A preferred application, in this context, covers internal combustion engines, and in this instance this configuration can be used, for example, for leading through water in the oil space.

By means of this configuration, both impairments of functional reliability and damage to the environment due to leakages which occur or to the intermixing of different fluids are avoided, this sealing-off making simple assembly possible and requiring only low component and production costs.

Other features which are considered as characteristic for the invention are set forth in the appended claims.

Although the invention is illustrated and described herein as embodied in a configuration for sealing off two fluid-carrying subassemblies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
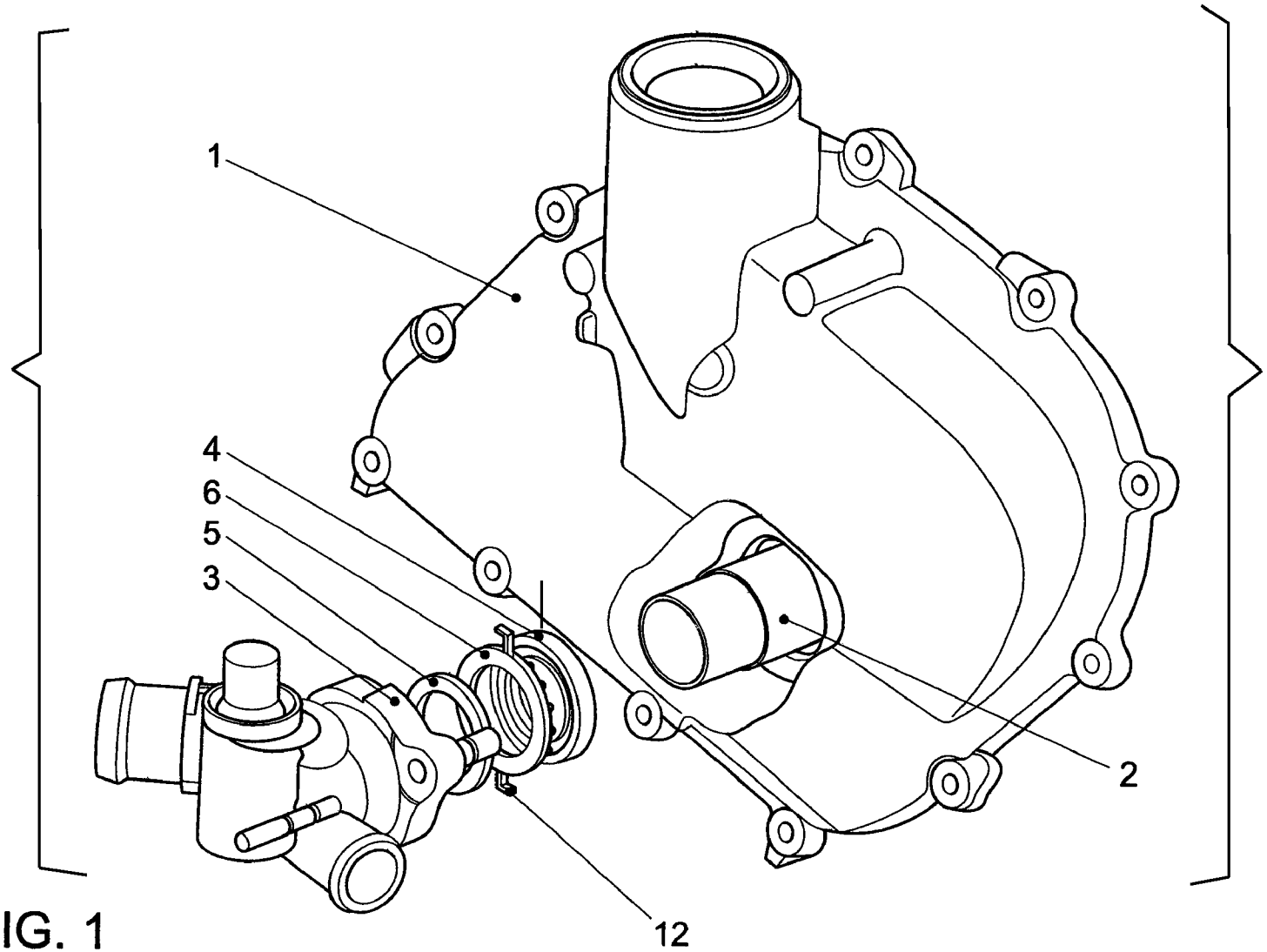
FIG. 1 is a perspective view of the basic construction of a configuration according to the invention.

Referring now to the figures of the drawing in detail and first, particularly, to FIG. 1 thereof, there is shown a configuration that is used for sealing off two fluid-carrying subassemblies. By way of example, there is illustrated an embodiment of subassemblies for carrying water through the oil space of an internal combustion engine.

Figure 2:
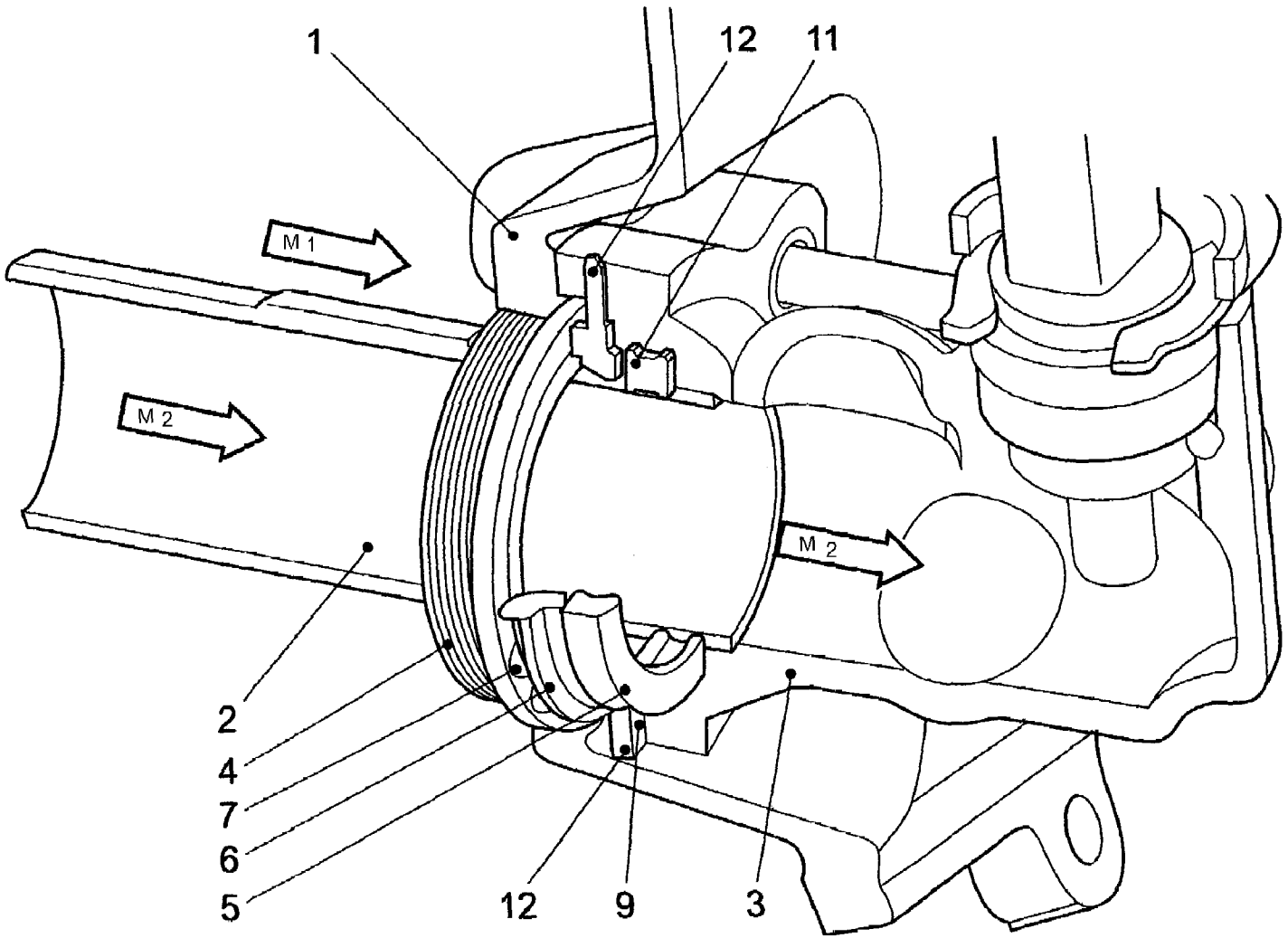
FIG. 2 is a sectional illustration of the configuration in the assembled state.
Figure 3:
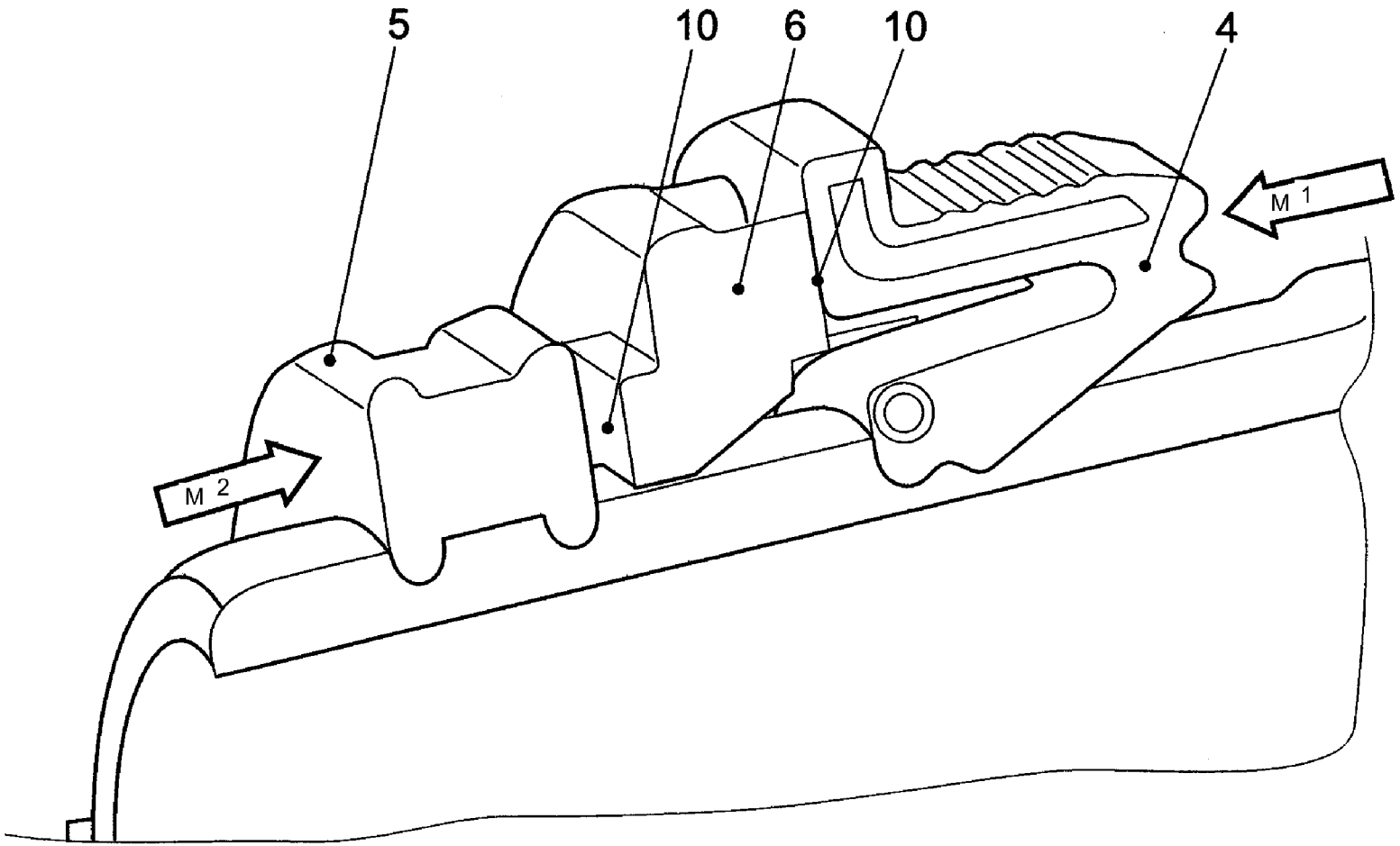
FIG. 3 shows a detail of the configuration.
Figure 4:
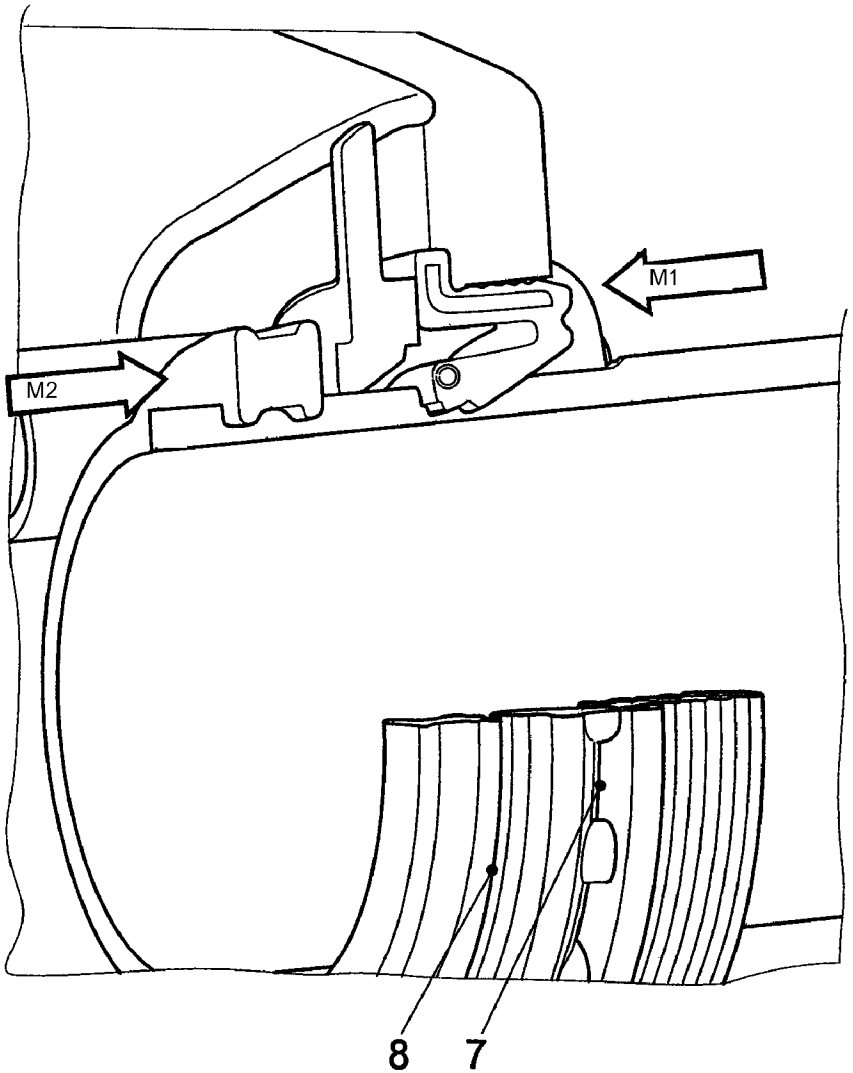
FIG. 4 shows a further detail of the configuration.

A case 1 is provided, the inner space of which is filled with a first fluid. This first fluid is stylized in the drawing by an arrow labeled M1 (FIGS. 2-4). A pipeline 2 which is filled with another fluid is led through the inner space of the case 1. The second fluid is stylized in the drawing by an arrow labeled M2. The second fluid from the pipeline 2 flows into a construction space 3 which may be designed as an independent subassembly. The construction space 3 is separated from the inner space, filled with the first fluid, of the case 1 by way of a wall.

As is evident particularly from FIG. 2 to FIG. 4, two sealing elements 4 and 5 are supported on the pipeline 2 in the region of the leadthrough of the pipeline 2 through the wall of the case 1. In this instance, the first sealing element 4 is operatively connected to the through-passage in the wall of the case 1. This sealing element 4 is designed in such a way that radial deformation for the compensation of tolerances is possible and seals off the inner space of the case 1. The inner space is acted upon by the first fluid (M1). The second sealing element 5 seals off the pipeline 2 and the second fluid (M2) with respect to the case 1.

In order to prevent an intermixing of the two different fluids in the event of leakage due to penetration into the other respective space, the two sealing elements 4 and 5 have arranged between them an additional supporting ring 6 which with respect to the sealing elements 4 and 5 forms a supporting shoulder and an outflow and which fulfills at least the following three functions:

easy mounting and demounting of the sealing elements;

supporting and securing the sealing elements;

formation of an outwardly open space which, in the event of leakage, diverts the corresponding fluid and prevents penetration and intermixing into the other fluid-carrying space.

For this purpose, the supporting ring 6 has, on each of its side faces assigned to the sealing elements 4 and 5, a contour 7, 8 for the reception and diversion of a fluid volume which has flowed onto the supporting ring 6 as a result of leakage in the region of the respectively assigned sealing elements 4 or 5. These contours 7 and 8 for the reception and diversion of leakage fluid volumes are preferably formed, on one side face of the supporting ring 6, on the side directed toward the pipeline 2 and, on the other side face of the supporting ring 6, on the side opposite to the pipeline 2. Furthermore, these contours 7 and 8 have at least one outflow orifice 9 for the respective fluid. Finally, the supporting ring 6, on its side faces assigned to the sealing elements 4 and 5, has, in addition to the contours 7 and 8 for the reception and diversion of fluid volumes, portions 10 which act in each case as a support for the sealing elements 4 and 5. These portions 10 have a contour which is configured largely congruently to the contour which the respectively assigned sealing element 4 or 5 has in this transitional region to the supporting ring 6.

Figure 5:
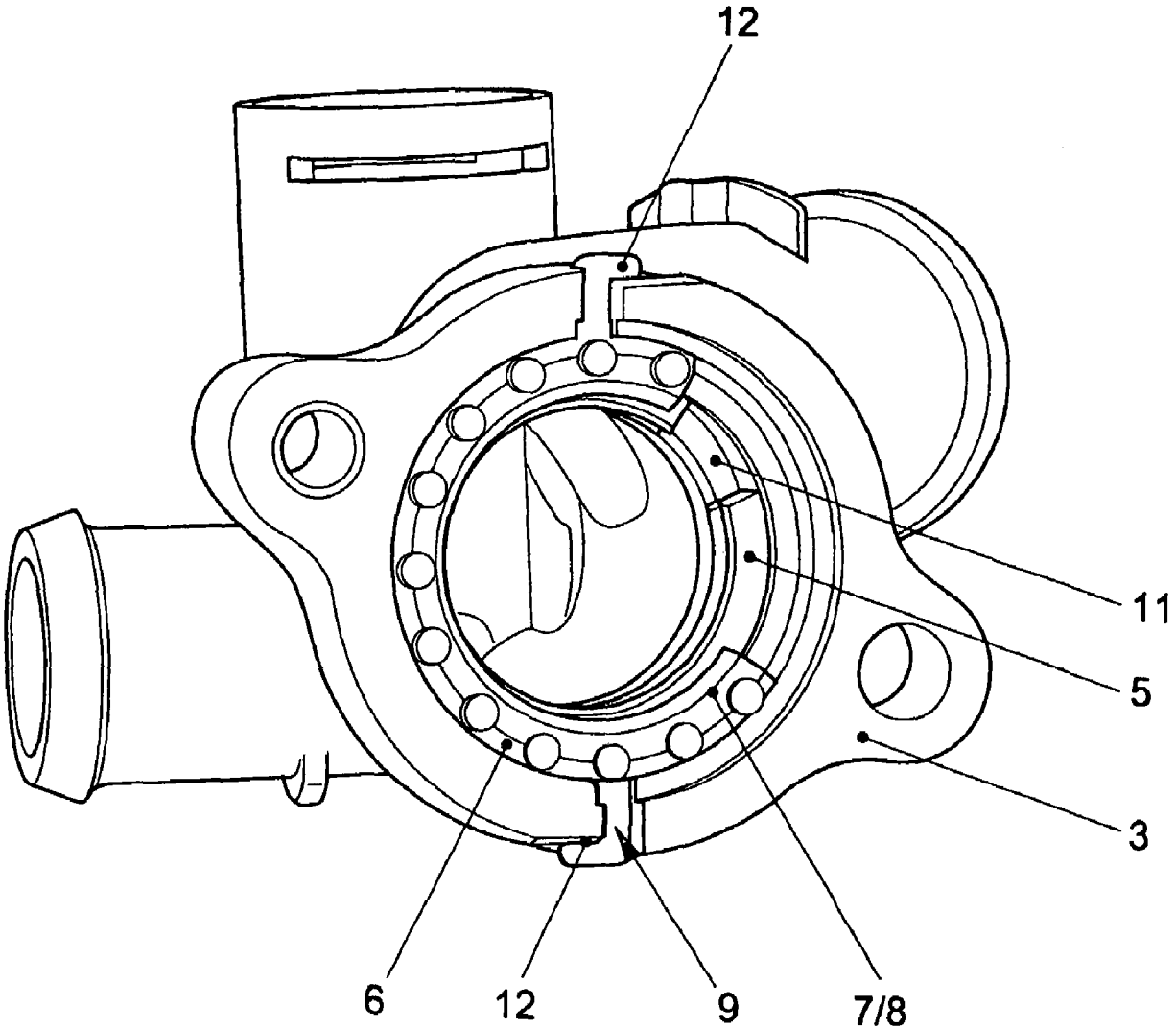
FIG. 5 shows a further detail of the configuration.

Assembly benefits arise insofar as at least one portion of a sealing groove is designed to be opened at one side, as is evident from the reference symbol 11 in FIG. 5. Assembly is further simplified insofar as the supporting ring 6 has on its circumference at least one radially outwardly directed projection 12 which is operatively connected to a largely congruent clearance in the case 1 or in the subassembly 3. In a preferred embodiment, two such projections 12 are provided, which have in each case a clip-like contour at their end portion (cf. FIG. 5). By way of these structural elements, a releasable interlocking of the supporting ring 6 in the case 1 or the subassembly 3 becomes possible. The leakage outflow orifices 9 formed on the supporting ring 6 may also be made in the region of these projections 12.

This application claims the priority, under 35 U.S.C. § 119, of German patent application DE 10 2004 056 599.6, filed Nov. 24, 2004; the foreign application is herewith incorporated by reference in its entirety.

I claim

1. A configuration for sealing off a first fluid-carrying subassembly from a second fluid-carrying subassembly, the configuration comprising:

a first subassembly having a case wall formed with a leadthrough and a second subassembly having a pipeline extending through the leadthrough;

a first sealing element and a second sealing element supported on the pipeline in a region of the leadthrough through the wall of the first subassembly;

a supporting ring disposed between said first sealing element and said second sealing element, said supporting ring having side faces respectively facing said first sealing element and said second sealing element, said side faces having contours for receiving and diverting a fluid volume flowing onto said supporting ring as a result of leakage at a respective one of said first and second sealing elements;

said supporting ring being seated on the pipeline of the second subassembly.

2. The configuration according to claim 1, wherein said contours have an outflow orifice for fluid.

3. The configuration according to claim 1, wherein said first sealing element has a contour and said second sealing element has a contour; and each of said side faces of said supporting ring has a portion with a contour configured largely congruently to said contour of a respective one of said first sealing element and said second sealing element.

4. The configuration according to claim 1, wherein said second sealing element includes a sealing groove.

5. The configuration according to claim 1, wherein:

the first subassembly has a case formed with a largely congruent clearance; and said supporting ring has a circumference formed with at least one radially outwardly directed projection to be connected operatively to the largely congruent clearance in the case of the first subassembly.

6. The configuration according to claim 5, wherein said supporting ring is formed with two radially outwardly directed projections, each having an end portion with a clip contour.

7. The configuration according to claim 5, wherein said contours have an outflow orifice for fluid formed in said radially outwardly directed projection.

8. The configuration according to claim 1, wherein the first subassembly is formed with a space containing a first fluid, the pipeline of the second subassembly is led through the space containing the first fluid, and the pipeline contains a second fluid different from the first fluid.

9. The configuration according to claim 8, wherein said contours of said side faces prevent the first fluid and the second fluid from being intermixed as a result of the leakage.

10. A configuration for sealing off a first space in a housing relative to a second space in the housing, the configuration comprising:

a housing formed with a first space, a second space, and a wall separating the first space from the second space, wherein the first space of the housing is configured to be filled with a first fluid;

a pipeline guided through the wall separating the first space from the second space and issuing into the second space, wherein the pipeline is configured to be filled with a second fluid;

a first sealing element and a second sealing element constructed to be supported on the pipeline in a region of a lead through the wall; and a supporting ring disposed between said first sealing element and said second sealing element, said supporting ring having side faces respectively facing said first sealing element and said second sealing element, said side faces having contours for receiving and diverting a fluid volume flowing onto said supporting ring as a result of leakage at a respective one of said first and second sealing elements;

said supporting ring being seated on the pipeline.

* * * * *